US010283312B2

(12) United States Patent
McCabe et al.

(10) Patent No.: US 10,283,312 B2
(45) Date of Patent: May 7, 2019

(54) SYSTEM AND METHOD FOR REDUCING RELATIVE BEARING SHAFT DEFLECTION IN AN X-RAY TUBE

(71) Applicant: General Electric Company, Schenectady, NY (US)

(72) Inventors: John James McCabe, Wauwatosa, WI (US); Michael Scott Hebert, Muskego, WI (US); Ian Strider Hunt, Sussex, WI (US); Andrew Thomas Triscari, Hubertus, WI (US); Kevin Shane Kruse, Muskego, WI (US); Alexander Thomas Ryan, Milwaukee, WI (US); Adolfo Delgado Marquez, College Station, TX (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 326 days.

(21) Appl. No.: 15/251,854

(22) Filed: Aug. 30, 2016

(65) Prior Publication Data

US 2018/0061611 A1 Mar. 1, 2018

(51) Int. Cl.
*H01J 35/10* (2006.01)

(52) U.S. Cl.
CPC ..... *H01J 35/101* (2013.01); *H01J 2235/1006* (2013.01); *H01J 2235/1046* (2013.01)

(58) Field of Classification Search
CPC ..... H01J 35/10; H01J 2235/10; H01J 6/03
See application file for complete search history.

(56) References Cited

U.S. PATENT DOCUMENTS

| | | | | |
|---|---|---|---|---|
| 3,055,083 | A | 7/1961 | Stobi | |
| 4,222,618 | A | 9/1980 | Miller, Jr. | |
| 5,140,624 | A * | 8/1992 | Chrisien | H01J 35/101 378/125 |
| 5,660,481 | A | 8/1997 | Ide | |
| 7,215,740 | B2 | 5/2007 | Fukushima et al. | |
| 8,582,722 | B2 | 11/2013 | Tadokoro et al. | |
| 2018/0061611 | A1 * | 3/2018 | McCabe | H01J 35/101 |
| 2018/0223908 | A1 * | 8/2018 | Hunt | H01J 35/16 |

OTHER PUBLICATIONS

Hattori, Hitoshi, et al., Proposal of a High Rigidity and High Speed Rotating Mechanism Using a New Concept Hydrodynamic Bearing in X-Ray Tube for High Speed Computed Tomography, Journal of Advanced Mechanical Design Systems, and Manufacturing, Nov. 5, 2008, pp. 105-114, vol. 3, No. 1.

* cited by examiner

*Primary Examiner* — Thomas R Artman
(74) *Attorney, Agent, or Firm* — Fletcher Yoder, P.C.

(57) ABSTRACT

An X-ray tube is provided. The X-ray tube includes a bearing configured to couple to an anode. The bearing includes a stationary member, a rotary member configured to rotate with respect to the stationary member during operation of the X-ray tube, and a support feature configured to minimize bending moment along a surface of the stationary member to reduce deflection of the stationary member relative to the rotary member due to radial loads during operation of the X-ray tube.

14 Claims, 13 Drawing Sheets

SYSTEM AND METHOD FOR REDUCING RELATIVE BEARING SHAFT DEFLECTION IN AN X-RAY TUBE

BACKGROUND

The subject matter disclosed herein relates to X-ray tubes, and, more specifically, to features for minimizing relative bearing shaft deflection and/or controlling rotor dynamic modes.

A variety of diagnostic and other systems may utilize X-ray tubes as a source of radiation. In medical imaging systems, for example, X-ray tubes are used in projection X-ray systems, fluoroscopy systems, tomosynthesis systems, and computer tomography (CT) systems as a source of X-ray radiation. The radiation is emitted in response to control signals during examination or imaging sequences. The radiation traverses a subject of interest, such as a human patient, and a portion of the radiation impacts a detector or a photographic plate where the image data is collected. In conventional projection X-ray systems the photographic plate is then developed to produce an image which may be used by a radiologist or attending physician for diagnostic purposes. In digital X-ray systems a digital detector produces signals representative of the amount or intensity of radiation impacting discrete pixel regions of a detector surface. In CT systems a detector array, including a series of detector elements, produces similar signals through various positions as a gantry is displaced around a patient.

An anode assembly (or target assembly) generally includes a rotor and a stator outside of the X-ray tube at least partially surrounding the rotor for causing rotation of an anode during operation of the X-ray tube. The anode is supported in rotation by a bearing, which, when rotated, also causes the anode to rotate. The bearing typically includes a shaft and a bearing sleeve disposed about the shaft to which the anode is attached. During operation of the X-ray system, the shaft experiences radial loads (e.g., due to centrifugal forces from the X-ray tube rotating on a CT gantry) along its surface that cause bending moments and relative deflection of the shaft causing the shaft to bend and contact or rub against the bearing sleeve. Over time, the bearing surfaces become worn and fails. The relative deflection of the bearing also reduces the maximum usable eccentricity and limits the load carrying capability of the shaft. In addition, undesirable rotor dynamic modes can also contribute to wear in the shaft.

BRIEF DESCRIPTION

In accordance with a first embodiment, an X-ray tube is provided. The X-ray tube includes a bearing configured to couple to an anode. The bearing includes a stationary member, a rotary member configured to rotate with respect to the stationary member during operation of the X-ray tube, and a support feature configured to minimize bending moment along a surface of the stationary member to reduce deflection of the stationary member relative to the rotary member due to radial loads during operation of the X-ray tube.

In accordance with a second embodiment, an X-ray tube is provided. The X-ray tube includes a bearing configured to couple to an anode. The bearing includes a stationary member, a rotary member configured to rotate with respect to the stationary member during operation of the X-ray tube, and a shaft disposed within the stationary member along a longitudinal length of the stationary member, wherein the shaft is configured to minimize bending moment along a surface of the stationary member to reduce deflection of the stationary member relative to the rotary member due to radial loads during operation of the X-ray tube.

In accordance with a third embodiment, a method for making an X-ray tube is provided. The method includes an X-ray tube comprising a bearing that comprises a stationary member and a rotary member configured to rotate with respect to the stationary member during operation of the X-ray tube, disposing a support feature within the bearing that is configured to minimize bending moment along a surface of the stationary member to reduce deflection of the stationary member relative to the rotary member due to radial loads during operation of the X-ray tube.

BRIEF DESCRIPTION OF THE DRAWINGS

These and other features, aspects, and advantages of the present subject matter will become better understood when the following detailed description is read with reference to the accompanying drawings in which like characters represent like parts throughout the drawings, wherein.

DETAILED DESCRIPTION

Figure 1:
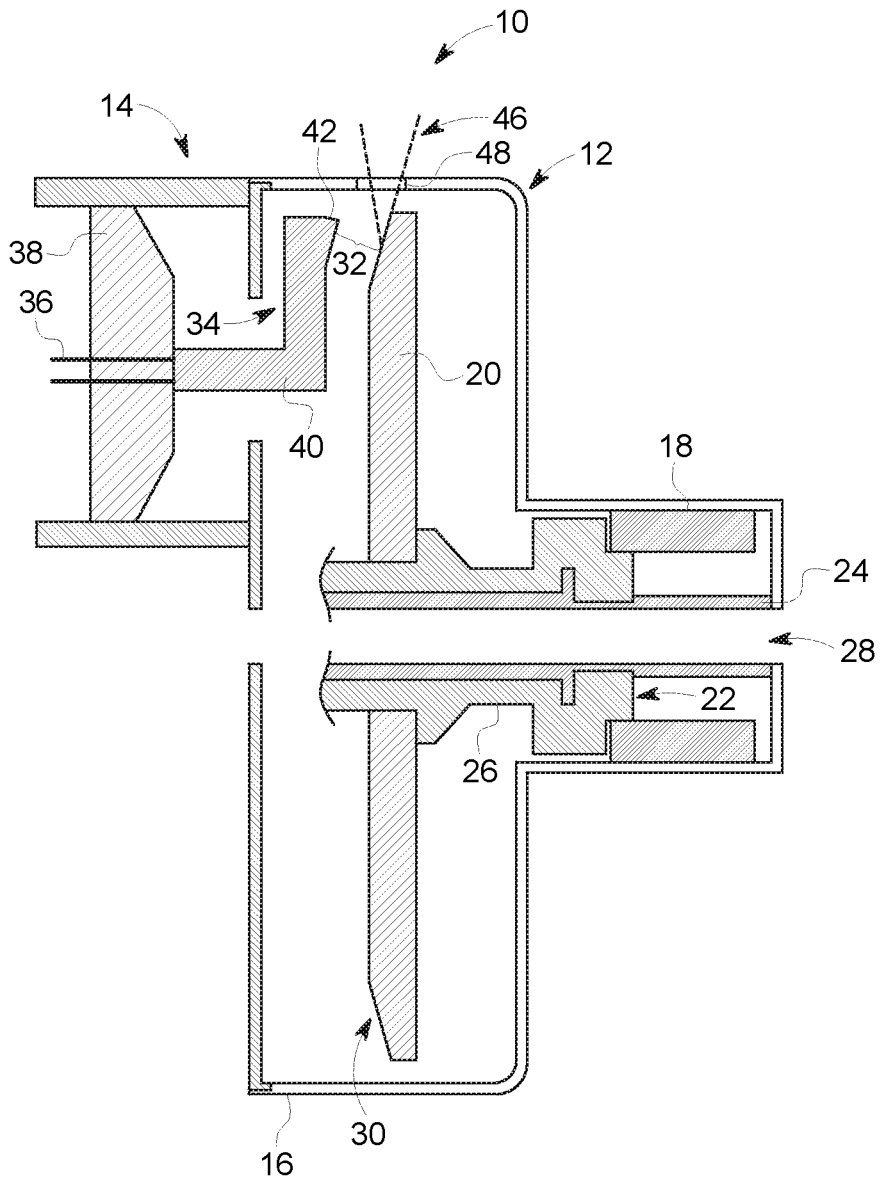
FIG. 1 is a diagrammatical illustration of an embodiment of an X-ray tube in which support features to minimize bending moment (and, thus, relative deflection relative to a bearing sleeve) along a surface of a shaft of a bearing, in accordance with the present disclosure.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

The embodiments disclosed herein provide support features to minimize bending moment (and thus deflection relative to a bearing sleeve) along a surface of a shaft of a bearing (liquid metal bearing, ball bearing, journal bearing, spiral groove bearing, etc.). In certain embodiments, the support feature may include a recess (e.g., relief undercut) adjacent one end or both ends of the shaft. In other embodiments, the support feature may include a cavity formed within the shaft. In certain embodiments, the support feature may include a secondary shaft disposed within the shaft that extends along a longitudinal length of the shaft. The support feature may include one or more protrusions that radially extend from the secondary shaft and contact an inner surface of the shaft at locations optimized to reduce relative deflections. In certain embodiments with the secondary shaft disposed within the shaft, one or more annular support structures may be disposed about the secondary shaft between the secondary shaft and the shaft. The annular support structure may be utilized to enable control of the rotor dynamics of the shaft and, thus, the bearing. In certain embodiments, the annular support structures may disposed about the shaft (e.g., between the shaft and an envelope of an X-ray tube at the ends of the shaft) to seal vacuum and reduce loads on the ends of the shaft. The disclosed embodiments may minimize deflection of the shaft relative to the bearing sleeve (i.e., relative deflection) by minimizing bending moments along a surface of the shaft. This may result in minimizing or eliminating rubbing between the shaft and the bearing sleeve. In addition, the maximum usable eccentricity and the load carrying capability of the shaft may be increased.

In the present disclosure, a non-limiting embodiment in which support features to minimize bending moment (and thus relative deflection relative to a bearing sleeve) along a surface of a shaft of a bearing (liquid metal bearing, ball bearing, journal bearing, spiral groove bearing, etc.) may be used is described with respect to FIG. 1. Variations of the support features are described with respect to FIGS. 4-10 and 19. It should be noted that although the support features are described with respect to an X-ray tube, the support features may be utilized with bearings in other apparatuses and/or applications. With the foregoing in mind, FIG. 1 illustrates an embodiment of an X-ray tube 10 that may include support features to minimize bending moment (and thus relative deflection relative to a bearing sleeve (e.g., rotary member)) along a surface of a shaft (e.g., stationary member) of a bearing (liquid metal bearing, ball bearing, journal bearing, spiral groove bearing, etc.) in accordance with the present approaches. In the illustrated embodiment, the X-ray tube 10 includes an anode assembly 12 and a cathode assembly 14. The X-ray tube 10 is supported by the anode and cathode assemblies within an envelope 16 defining an area of relatively low pressure (e.g., a vacuum) compared to ambient, in which high voltages may be present. The envelope 16 may be within a casing (not shown) that is filled with a cooling medium, such as oil, that surrounds the envelope 16. The cooling medium may also provide high voltage insulation.

The anode assembly 12 generally includes a rotor 18 and a stator outside of the X-ray tube 10 (not shown) at least partially surrounding the rotor 18 for causing rotation of an anode 20 during operation. The anode 20 is supported in rotation by a bearing 22, which, when rotated, also causes the anode 20 to rotate. The anode 20 has an annular shape, such as a disc, and an annular opening in the center thereof for receiving the bearing 22. In general, the bearing 22 includes a stationary portion, such as a shaft 24 and a rotary portion, such as a bearing sleeve 26 to which the anode 20 is attached. While the shaft 24 is presently described in the context of a stationary shaft, it should be noted that the present approaches are also applicable to embodiments wherein the shaft 24 is a rotary shaft. In such a configuration, it should be noted that the X-ray target would rotate as the shaft rotates. In certain embodiments, the bearing 22 maybe a journal bearing, a ball bearing, or a spiral groove bearing. Keeping the foregoing in mind, in one embodiment, the bearing 22 may have a liquid metal lubricant disposed between the bearing sleeve 26 and the shaft 24. Indeed, some embodiments of the bearing 22 may conform to those described in U.S. patent application Ser. No. 12/410,518 entitled "INTERFACE FOR LIQUID METAL BEARING AND METHOD OF MAKING SAME," filed on Mar. 25, 2009, the full disclosure of which is incorporated by reference herein in its entirety for all purposes. The shaft 24 may optionally include a coolant flow path 28 through which a coolant, such as oil, may flow so as to cool the bearing 22. In the illustrated embodiment, the coolant flow path 28 extends along a longitudinal length of the X-ray tube 10, which is depicted as a straddle configuration. However, it should be noted that in other embodiments, the coolant flow path 28 may extend through only a portion of the X-ray tube 10, such as in configurations where the X-ray tube 10 is cantilevered when placed in an imaging system.

During operation, rotation of the bearing 22 advantageously allows a front portion of the anode 20, which has a target or focal surface 30 formed thereon, to be periodically struck by an electron beam 32, rather than continuously. Such periodic bombardment may allow the resulting thermal energy to be dispersed, rather than concentrated, which may result in one or more anode failure modes (e.g., cracking, deformation, rupture). Generally, the anode 20 may be rotated at a high speed (e.g., 100 to 200 Hz). The anode 20 may be manufactured to include a number of metals or composites, such as tungsten, molybdenum, copper, or any material that contributes to Bremsstrahlung (i.e., deceleration radiation) when bombarded with electrons. The anode's surface material is typically selected to have a relatively high refractory value so as to withstand the heat generated by electrons impacting the anode 20. Further, the space between the cathode assembly 14 and the anode 20 may be evacuated in order to minimize electron collisions with other atoms and to maximize an electric potential. In some X-ray tubes, voltages in excess of 160 kV are created between the cathode assembly 14 and the anode 20, causing electrons emitted by the cathode assembly 14 to become attracted to the anode 20.

The electron beam 32 is produced by the cathode assembly 14 and, more specifically, a cathode 34 that receives one or more electrical signals via a series of electrical leads 36. The electrical signals may be timing/control signals that cause the cathode 34 to emit the electron beam 32 at one or more energies and at one or more frequencies. Further, the electrical signals may at least partially control the potential between the cathode 34 and the anode 20. The cathode 34 includes a central insulating shell 38 from which a mask 40 extends. The mask 40 encloses the leads 36, which extend to a cathode cup 42 mounted at the end of the mask 40. In some embodiments, the cathode cup 42 serves as an electrostatic lens that focuses electrons emitted from a thermionic filament within the cup 42 to form the electron beam 32.

As control signals are conveyed to cathode 34 via leads 36, the thermionic filament within cup 42 is heated and produces the electron beam 32. The beam 32 strikes the focal surface 30 of the anode 20 and generates X-ray radiation 46, which is diverted out of an X-ray aperture 48 of the X-ray tube 10. The direction and orientation of the X-ray radiation 46 may be controlled by a magnetic field produced outside of the X-ray tube 10, or through electrostatic means at the cathode 34, and the like. The field produced may generally shape the X-ray radiation 46 into a focused beam, such as a cone-shaped beam as illustrated. The X-ray radiation 46 exits the tube 10 and is generally directed towards a subject of interest during examination procedures.

As noted above, the X-ray tube 10 may be utilized in systems where the X-ray tube 10 is displaced relative to a patient, such as in CT imaging systems where the source of X-ray radiation rotates about a subject of interest on a gantry. As the X-ray tube 10 rotates along the gantry, various forces, such as centrifugal forces, are placed on the bearing 22. The load (e.g., radial load) on the shaft may, in certain situations, cause a bending moment along the surface of the shaft 24 resulting in bending and deflection (i.e., relative deflection) of the shaft 24 relative to the bearing sleeve 26. This relative deflection may cause the shaft 24 to rub against the sleeve 26 resulting in wear of both the shaft 24 and the sleeve 26 over time. To mitigate the effect of the relative deflection due to the bending moment, the present embodiments provide one or more support features to minimize bending moment (and thus relative deflection relative) along a surface of the shaft 24 of the bearing 22 during operation of the X-ray tube 10.

Figure 2:
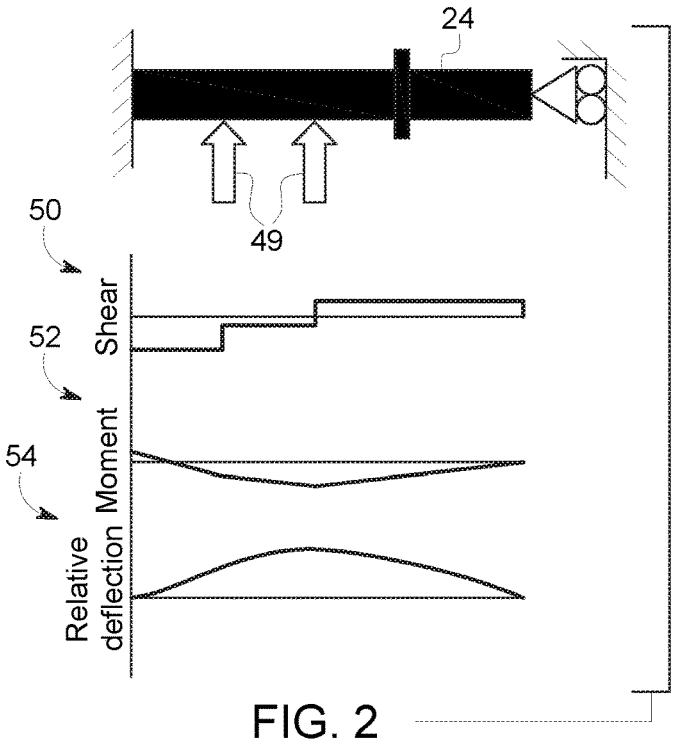
FIG. 2 is a diagrammatical illustration of the effect of loads on a shaft of a bearing during operation of an X-ray tube.

FIG. 2 is a diagrammatical illustration of the effect of loads on the shaft 24 of the bearing 22 during operation of the X-ray tube 10 in the absence of any support features to minimize the bending moment. FIG. 2 depicts a non-limiting example of locations along the shaft 24 that may experience loads 49 (e.g., radial loads) during operation of the X-ray tube 10. It should be noted that the location of these loads 49 may vary along the shaft 24 depending on the operational conditions and mechanical structure of both the bearing 22 and the X-ray tube 10. FIG. 2 also depicts a shear diagram 50, a bending moment diagram 52, and a relative deflection diagram 54. The shear diagram 50 illustrates that the shaft 24 (in the absence of support features) is subject to shear forces (i.e., unaligned forces) along its longitudinal length that cause portions of the shaft 24 to move in one direction and other portions of the shaft 24 to move in another direction. The moment diagram 52 illustrates that the shaft 24 (in the absence of support features) is subject to a bending moment along its longitudinal length that causes the shaft 24 to bend. The relative deflection diagram 54 illustrates that the shaft 24 (in the absence of support features) is subject to deflection (e.g., relative deflection with respect to the bearing sleeve 26) along its longitudinal length due to the shear forces and bending moment that may cause the shaft 24 to rub against the bearing sleeve 26.

Figure 3:
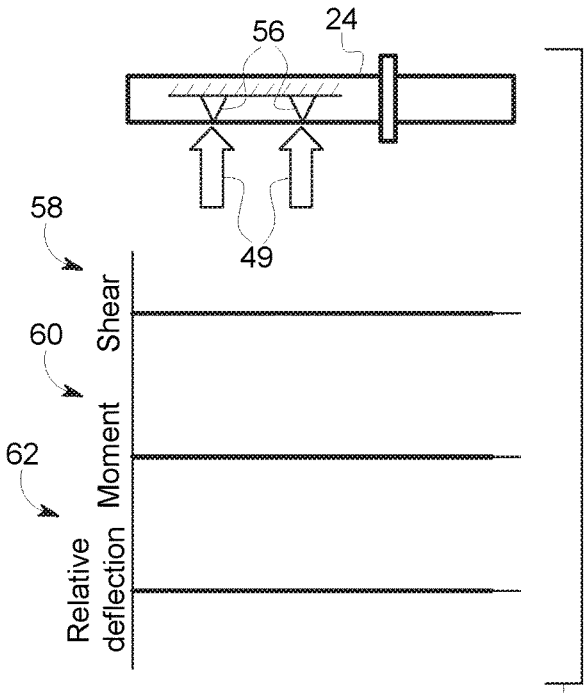
FIG. 3 is a diagrammatical illustration of an embodiment of the effect of loads on a shaft of a bearing during operation of an X-ray tube in the presence of supports features to minimize bending moment along a surface of the shaft.

FIG. 3 is a diagrammatical illustration of the effect of loads on the shaft 24 of the bearing 22 during operation of the X-ray tube 10 in the presence support features to minimize the bending moment. These supports features, which are described in greater detail below, may include a recess (e.g., relief undercut) formed in the shaft 24 adjacent one end or both ends of the shaft 24, a cavity formed within the shaft 24, or a secondary shaft disposed within the shaft 24 that extends along a longitudinal length of the shaft 24. In certain embodiments utilizing the secondary shaft, one or more annular support structures may be disposed about the secondary shaft to tune or control the rotor dynamics of the bearing 22 (see FIG. 19). In other embodiments, also utilizing the secondary shaft, one or more annular support structures may be disposed about the ends of the shaft 24 (e.g., between the shaft and the envelope 16) to seal vacuum and reduce loads on the ends of the shaft 24. FIG. 3 depicts a non-limiting example of locations (e.g., same location as FIG. 2) along the shaft 24 that may experience loads 49 (e.g., radial loads) during operation of the X-ray tube 10. The locations of the support features 56 are represented by the triangles. It should be noted the location of these loads 49 as well as the number and location of the supports features 56 may vary along the shaft 24 depending on the operational conditions and mechanical structure of both the bearing 22 and the X-ray tube 10. FIG. 3 also depicts a shear diagram 58, a bending moment diagram 60, and a relative deflection diagram 62. The shear diagram 58 illustrates that the shaft 10 (in the presence of support features 56) is not subject to shear forces (i.e., unaligned forces) along its longitudinal length. The moment diagram 60 illustrates that the shaft 24 (in the presence of support features 56) is not subject to a bending moment along is longitudinal length. The relative deflection diagram 62 illustrates that the shaft 24 (in the presence of support features 56) is not subject to deflection (e.g., relative deflection with respect to the bearing sleeve 26) along its longitudinal length due to the absence of shear forces and bending moment. In certain embodiments, the supports features 56 may minimize the shear forces and bending moment acting along the longitudinal length of the shaft 24 to keep the shaft from contacting or rubbing against the bearing sleeve 26. The support features 56 may increase the maximum usable eccentricity and the load carrying capability of the shaft 24.

Figure 4:
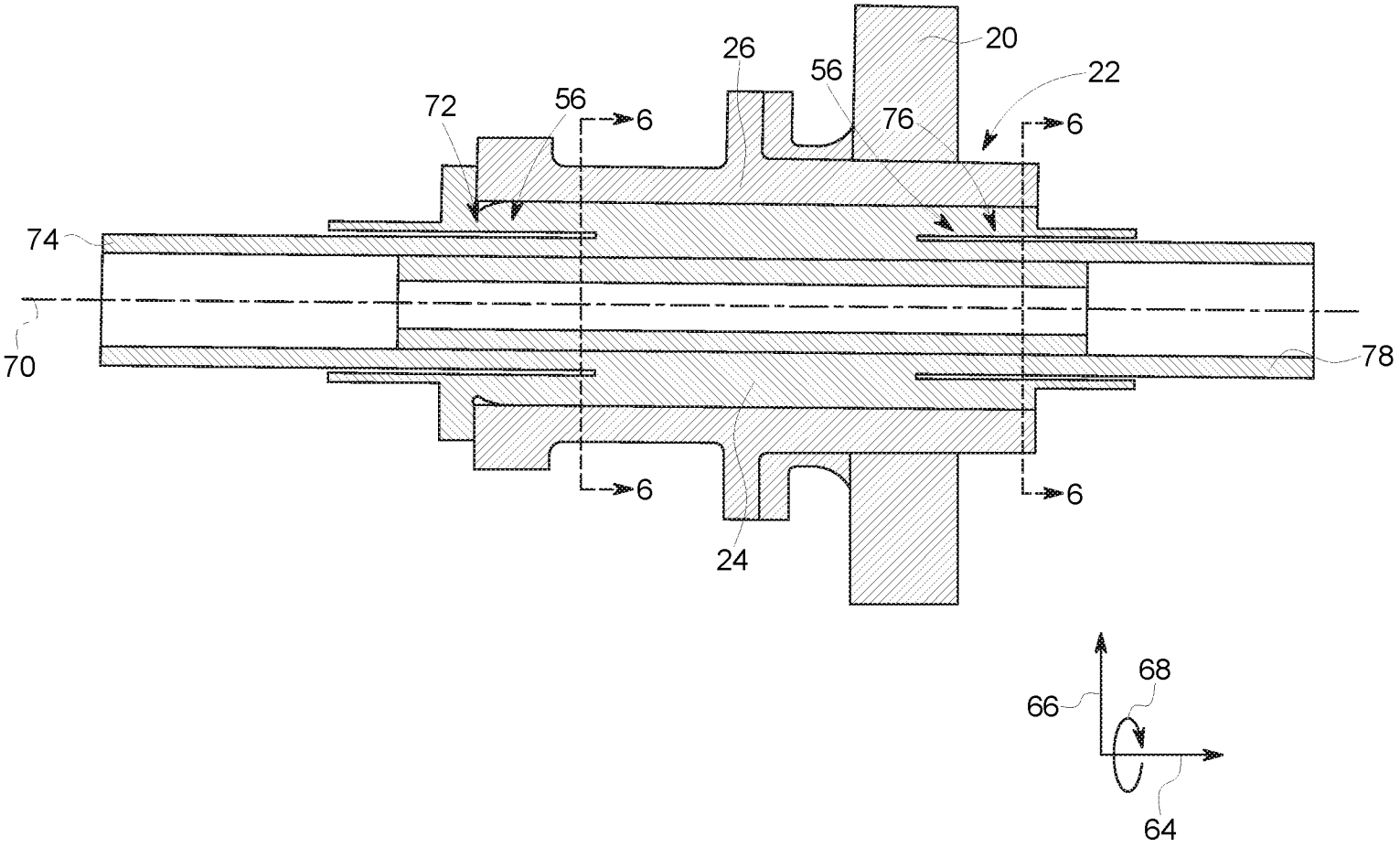
FIG. 4 is a diagrammatical illustration of an embodiment of a bearing within an X-ray tube having support features (e.g., recess) in a shaft.

FIG. 4 is a diagrammatical illustration of an embodiment of the bearing 22 within the X-ray tube 10 having support features 56 (e.g., recess) in the shaft 24. The bearing 22 may be described in this and subsequent figures by referencing an axial direction 64, a radial direction 66, and a circumferential direction 68 relative to a longitudinal axis 70 of the bearing 22, the shaft 24, a secondary shaft, and/or the bearing sleeve 26. In general, the shaft 24 and the bearing sleeve 26 are as described in FIG. 1. As depicted in FIG. 4, a first recess 72 (e.g., relief undercut) is formed in the shaft 24 adjacent a first end 74 of the shaft 24 and a second recess 76 (e.g., relief undercut) is formed in the shaft 24 adjacent a second end 78 of the shaft 24. The first and second recesses 72, 76 extend in both the axial direction 64 (e.g., partially) and the circumferential direction 68 relative to the longitudinal axis 70 of the shaft 24. In certain embodiments, the recesses 72, 76 may extend circumferentially 68 360 degrees about the longitudinal axis 70. In other embodiments, the recesses 72, 76 may extend only partially about the longitudinal axis 70. In certain embodiments, multiple recesses may extend partially about the longitudinal axis 70 at a same axial location. In certain embodiments, the shaft 24 may include only a single recess (or multiple recesses at a single axial location) adjacent a single end of the shaft 24. The recesses 72, 76 minimize or relieve a bending moment along a surface of the shaft 24 to keep the shaft 24 from bending (thus, minimizing relative deflection).

Figure 5:
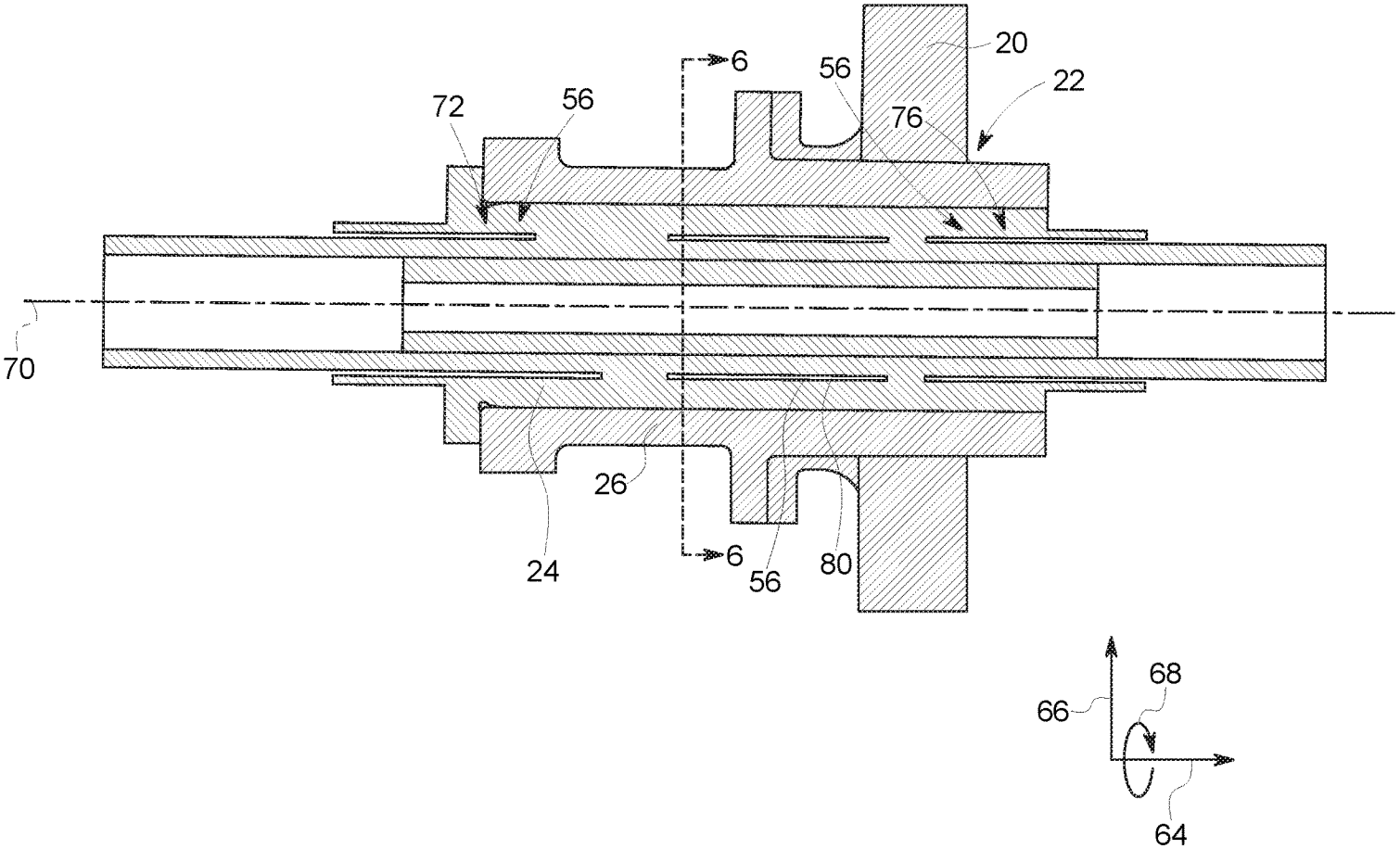
FIG. 5 is a diagrammatical illustration of an embodiment of a bearing within an X-ray tube having support features (e.g., recess and cavity) in a shaft.

FIG. 5 is a diagrammatical illustration of an embodiment of the bearing 22 within the X-ray tube 10 having support features 56 (e.g., cavity) in the shaft 24. In general, the shaft 24 and the bearing sleeve 26 are as described in FIG. 1. As depicted in FIG. 5, in addition to recesses 72, 76, a cavity 80 is formed (e.g., cast) in the shaft 24. The cavity 80 extends in both the axial direction 64 and the circumferential direction 68 relative to the longitudinal axis 70 of the shaft 24. In certain embodiments, the cavity 80 may extend in the circumferentially 68 360 degrees about the longitudinal axis 70. In other embodiments, the cavity 80 may extend only partially about the longitudinal axis 70. In certain embodiments, multiple cavities may extend partially about the longitudinal axis 70 at a same axial location. In certain embodiments, the cavity 80 may be formed in the shaft 24 by coupling together two shaft pieces each having a respective end partially defining the cavity 80 that when joined together define the cavity 80. The cavity 80 minimizes or relieves a bending moment along a surface of the shaft 24 to keep the shaft 24 from bending (thus, minimizing relative deflection). In particular, the cavity 80 (together with the recesses 72, 76) may reduce the relative deflection even more than the recesses alone 72, 76.

Figure 6:
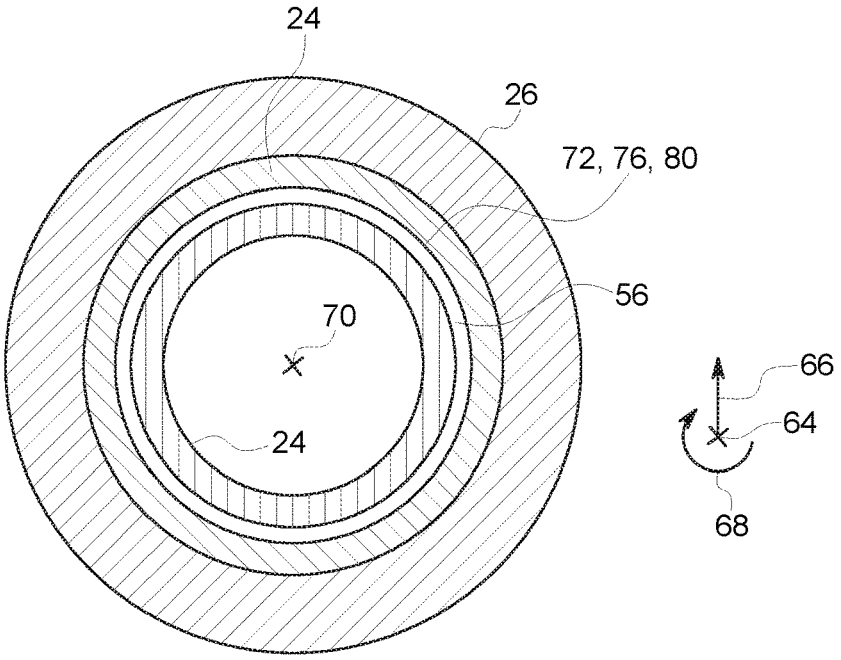
FIG. 6 is a cross-sectional view of an embodiment of the support features (e.g., recess or cavity) in the shaft, taken along line 6-6 in FIGS. 4 and 5.

FIG. 6 is a cross-sectional view of an embodiment of the support features 56 (e.g., recess 72, 76, or cavity 80) in the shaft 24, taken along line 6-6 in FIGS. 4 and 5. As depicted in FIG. 6, the recess 72, 76 or cavity 80 extends in the circumferential direction 68 360 degrees about the longitudinal axis 70 within the shaft 24. In certain embodiments, the recess 72, 76 or cavity 80 (e.g., a single recess or cavity at a particular axial location) may only extend circumferentially 68 about the longitudinal axis 70 within the shaft 24.

Figure 7:
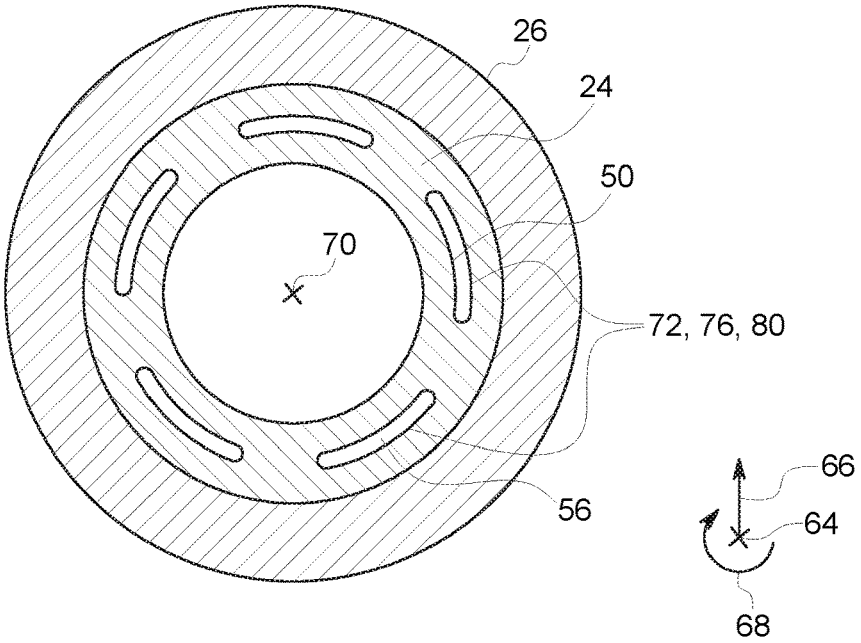
FIG. 7 is a cross-sectional view of an embodiment of the support features (e.g., multiple recesses or cavities) in the shaft, taken along line 6-6 in FIGS. 4 and 5.

FIG. 7 is a cross-sectional view of an embodiment of the support features 56 (e.g., multiple recesses 72, 76, or cavities 80) in the shaft 24, taken along line 6-6 in FIGS. 4 and 5. As depicted in FIG. 6, each of the multiple recesses 72, 76 or cavities 80 only extend circumferentially 68 partially about the longitudinal axis 70 within the shaft 24 at a single axial location. The number of multiple recesses 72, 76 or cavities 80 at the single axial location may vary between 2 to 10 or any other number.

Figure 8:
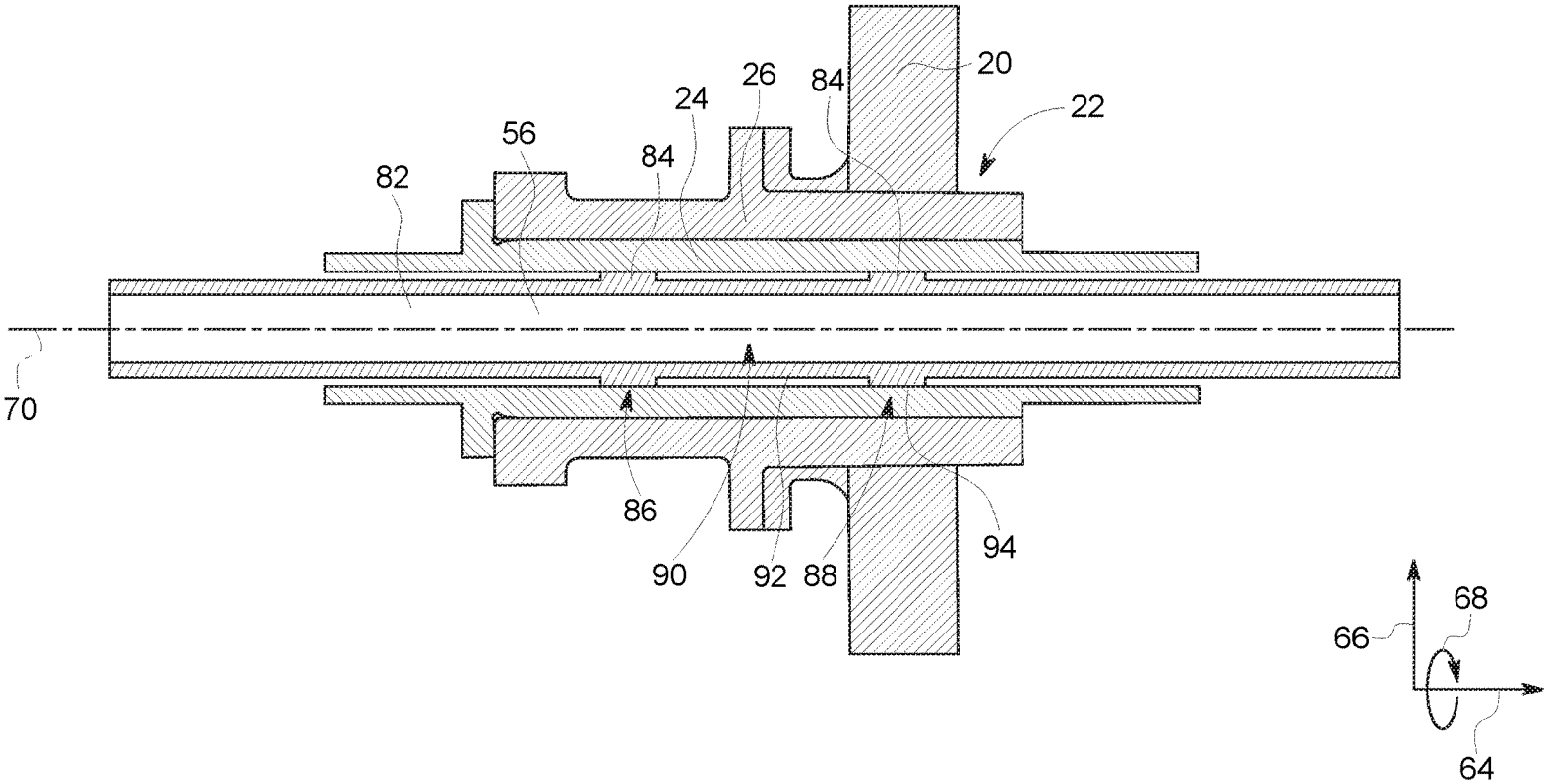
FIG. 8 is a diagrammatical illustration of an embodiment of a bearing within an X-ray tube having support features (e.g., secondary shaft made of a single piece) in a shaft.

FIG. 8 is a diagrammatical illustration of an embodiment of the bearing 22 within the X-ray tube 10 having support features 56 (e.g., secondary shaft 82) in the shaft 24. As depicted in FIG. 8, the secondary shaft 82 is disposed within the shaft 24 along a longitudinal length of the shaft 24. The secondary shaft 82 is made of a single piece. In certain embodiments, the secondary shaft 82 is made of two pieces joined together (see FIG. 9). The secondary shaft 82 may by supported by various components of the X-ray tube 10 (e.g., busing on stator cover, cathode housing, etc.). The shaft 24 includes protrusions 84 at two different axial locations 86, 88 (e.g., relative to the longitudinal axis 70) adjacent a central portion 90 of the bearing 22. The protrusions 84 radially 66 extend from an outer surface 92 of the secondary shaft 82 and contact an inner surface 94 of the shaft 24 at locations optimized to reduce relative deflections. In certain embodiments, the protrusions 84 are configured to generate an inverse deflection under small radial loads to optimize bearing deflection under higher radial load. In certain embodiments, these may be location that experience the highest hydrodynamic pressure (e.g., due to the centrifugal forces acting upon both the shaft 24, bearing sleeve 26, and the liquid metal bearing material disposed between the shaft 24 and the bearing sleeve 26). In addition, the number and location of the protrusions 84 as well as stiffness may be varied to tune or control the rotor dynamics of the bearing 22. Each protrusion 84 extends in both the circumferential direction 68 and the axial direction 64 relative to the longitudinal axis 70. In certain embodiments, each protrusion 84 extends circumferentially 68 360 degrees about the secondary shaft 82 relative to the longitudinal axis 70. In other embodiments, each protrusion 84 extends circumferentially 68 only partially about the secondary shaft 82 relative to the longitudinal axis 70. In certain embodiments, the number of axial locations having protrusions 84 may vary between 1 and 10 or any other number. In certain embodiments, each axial location may have a single protrusion 84. In other embodiments, each axial location may include multiple protrusions 84 that each extend circumferentially 68 partially about the secondary shaft 82 relative to the longitudinal axis 70. In certain embodiments, the secondary shaft 82 (instead of protrusions 84) includes one or more annular support structures disposed about the secondary shaft 82 (e.g., between the shaft 24 and the secondary shaft 82). The number and location of the annular support structures as well as stiffness may be varied to tune or control the rotor dynamics of the bearing 22. The secondary shaft 82 is configured to absorb relative deflection due to radial loads during operation of the X-ray tube 10. The secondary shaft 82 minimizes or relieves a bending moment along a surface of the shaft 24 to keep the shaft 24 from bending (thus, minimizing relative deflection).

Figure 9:
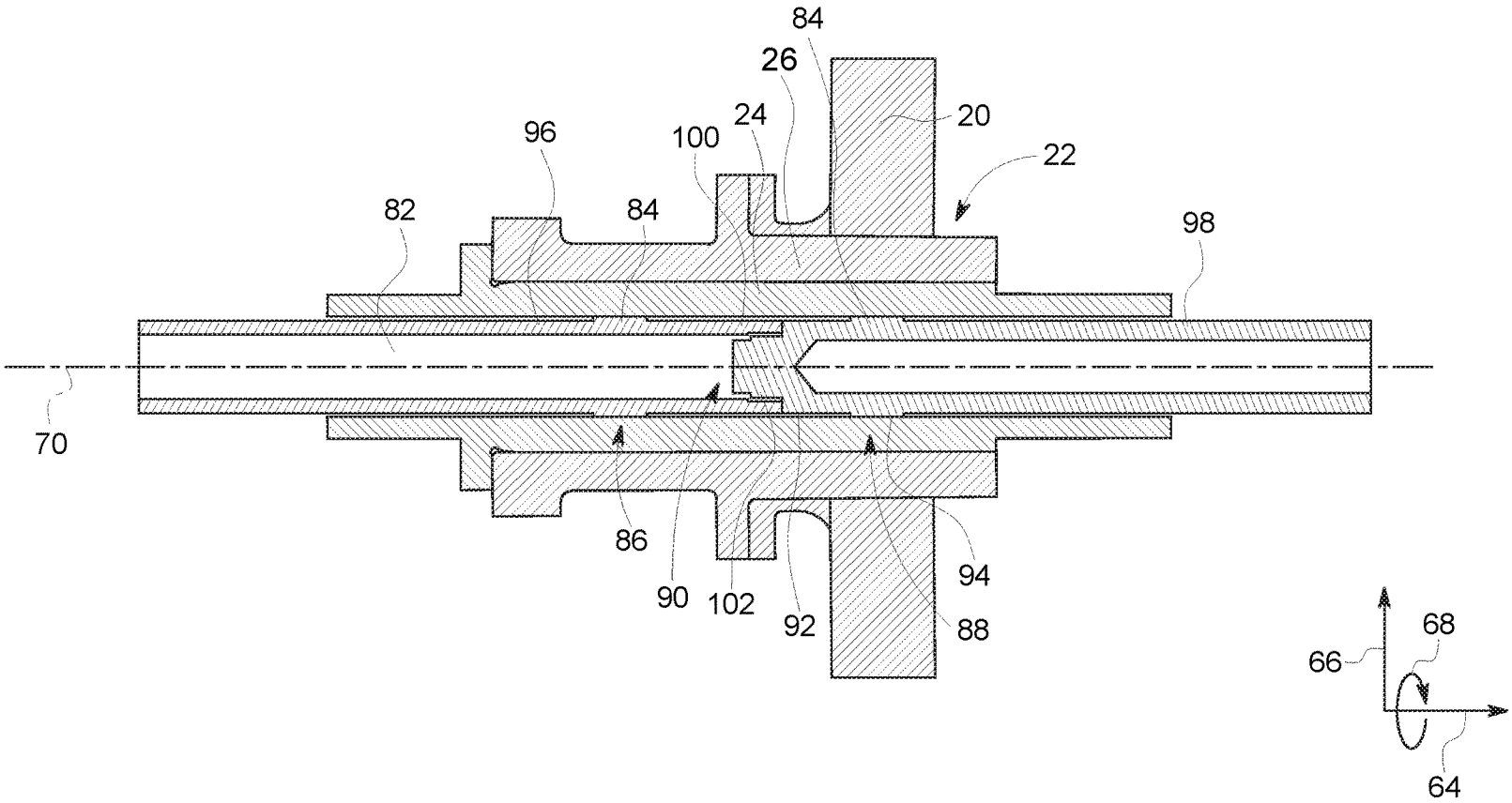
FIG. 9 is a diagrammatical illustration of an embodiment of a bearing within an X-ray tube having support features (e.g., secondary shaft made of two pieces) in a shaft.

FIG. 9 is a diagrammatical illustration of an embodiment of the bearing 22 within the X-ray tube 10 having support features 56 (e.g., secondary shaft 82 made of two pieces) in the shaft 24. In general, the secondary shaft 82 is as described above in FIG. 2 except the secondary shaft is made of two pieces 96, 98 fastened together at respective ends 100, 102. In certain embodiments, the two pieces 96, 98 may not be coupled together.

Figure 10:
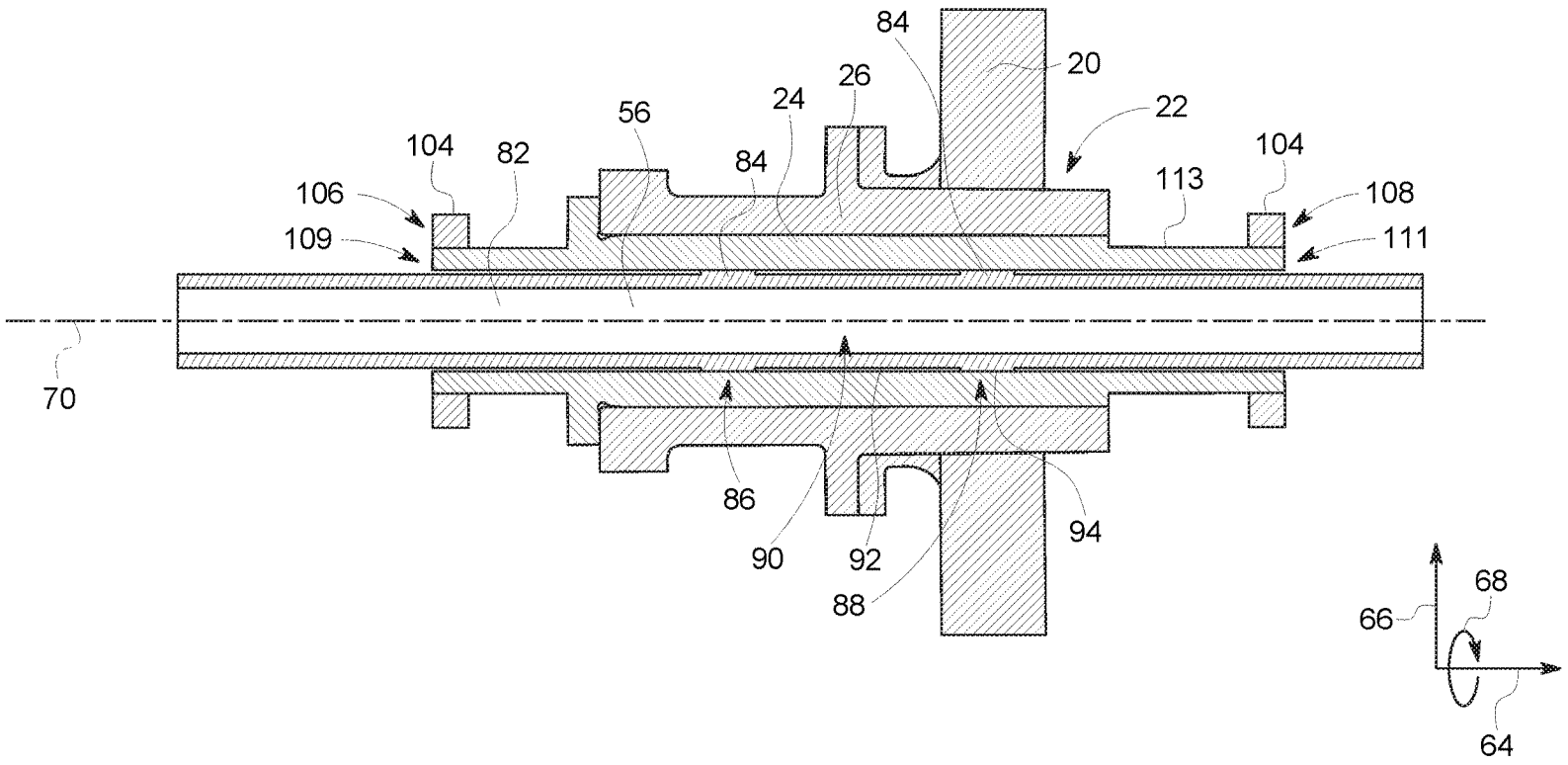
FIG. 10 is a diagrammatical illustration of an embodiment of a bearing within an X-ray tube having support features (e.g., secondary shaft) in and on a shaft.

As mentioned above, in embodiments utilizing the secondary shaft 82, one or more annular support structures may be disposed about the shaft 24 (e.g., adjacent the ends of the shaft 24) between the shaft 24 and the envelope (not shown). FIG. 10 is a diagrammatical illustration of an embodiment of the bearing 22 within the X-ray tube 12 having support features 56 (e.g., secondary shaft 82 having protrusions 84) in and on the shaft 24. As depicted in FIG. 8, the secondary shaft 82 is disposed within the shaft 24 along a longitudinal length of the shaft 24. The secondary shaft 82 includes the protrusions 84 as described above. As depicted, the secondary shaft 82 is made of a single piece. In certain embodiments, the secondary shaft 82 is made of two pieces joined together (see FIG. 9). The secondary shaft 82 may by supported by various components of the X-ray tube 10 (e.g., busing on stator cover, cathode housing, etc.). Annular support structures 104 are circumferentially 68 disposed about the shaft 24 at two different axial locations 106, 108 (e.g., relative to the longitudinal axis 70) adjacent ends 109, 111 of the shaft 24. The annular support structures 104 radially 66 extend from the outer surface 113 of the shaft 24. The annular support structures 104 may reduce loads on the ends 109, 11 of the shaft 24 while providing a seal vacuum. In certain embodiments, the number of annular support structures 104 and the axial locations along the shaft 24 may vary. In certain embodiments, instead of protrusions 84, the secondary shaft 82 (see FIG. 19) includes annular support structures 104 disposed about the secondary shaft 82 (e.g., between the secondary shaft 82 and the bearing sleeve 26) that enable tuning or control of the rotor dynamics of the bearing 22. The number and axial locations (e.g., along the secondary shaft 82) as well as stiffness (e.g., at different axial locations) of the annular support structures 104 may vary. The annular support structures described below in FIGS. 11-18 may be made via electrical discharge machining, molding, conventional machining, or additive manufacturing.

Figure 11:
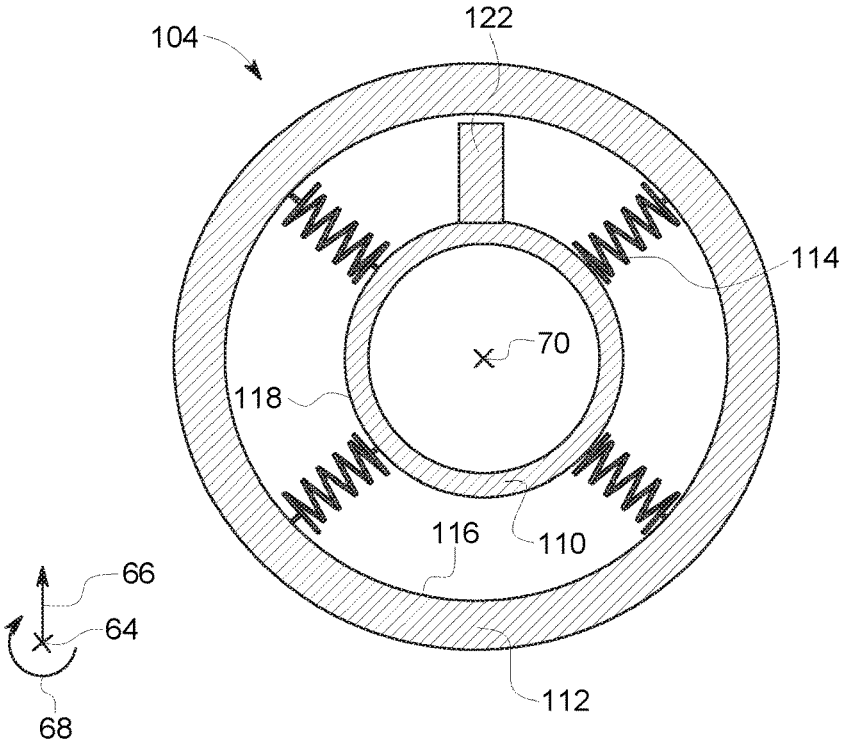
FIG. 11 is an end view of an embodiment of an annular support structure.
Figure 12:
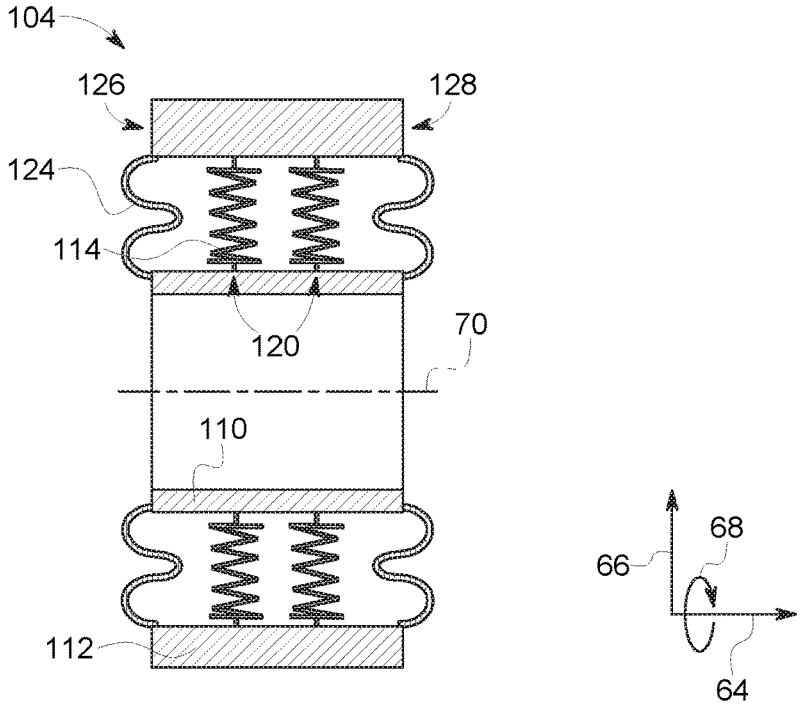
FIG. 12 is a lateral view of the annular support structure of FIG. 11.

FIGS. 11 and 12 are, respectively, end and lateral views of an embodiment the annular support structure 104. The annular support structure 104 includes an inner ring or cylinder 110 disposed within an outer ring or cylinder 112 in a concentric arrangement. A plurality of flexible elements 114 (e.g., springs) are radially 66 disposed between the inner and outer rings 110, 112. The flexible elements 114 are circumferentially 68 disposed about the longitudinal axis 70 and radially 66 extend between an inner surface 116 of the outer ring 112 and an outer surface 118 of the inner ring 110. The number of flexible elements 114 may range between 1 and 30 or any other number. The flexible elements 114 may be disposed at a single or multiple axial locations 120 relative to the longitudinal axis 70. In certain embodiments, as depicted in FIG. 11, a protrusion or hard stop 122 radially 66 extends from the inner ring 110 towards the outer ring 112. The protrusion 122 limits the radial movement of the inner ring 110 ring relative to the outer ring 112. In certain embodiments, the protrusion 122 radially 66 extends from the outer ring 112 towards the inner ring 110. As depicted in FIG. 12, the one or more seals 124 disposed on one or both sides 126, 128 of the annular support structure 104. The seals 124 are flexible. In certain embodiments, the seals 124 may have a lower stiffness than the flexible elements 114. In certain embodiments, the seals 124 enable the annular support structure 104 to help provide a sealing vacuum between the structures the annular support structure is disposed between.

Figure 13:
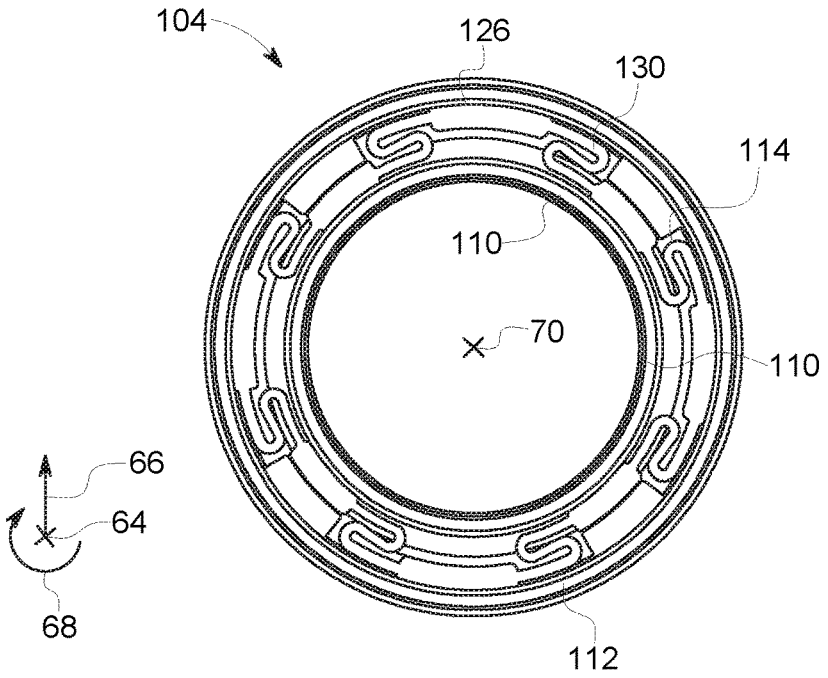
FIG. 13 is an end view of an embodiment of an annular support structure (e.g., having serpentine flexible elements)
Figure 14:
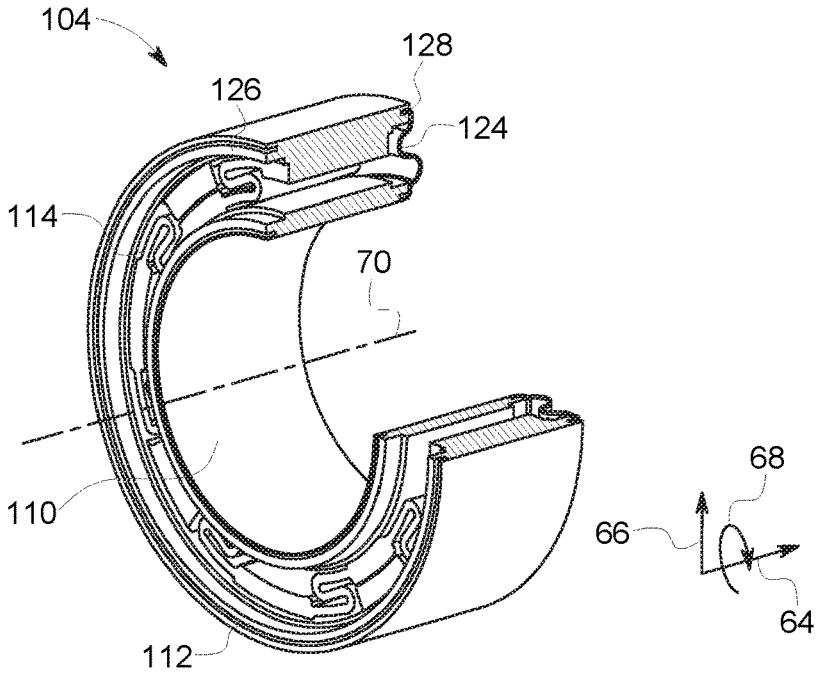
FIG. 14 is a partial perspective view of the annular support structure of FIG. 13.

FIGS. 13 and 14 are, respectively, end and partial perspective views of an embodiment the annular support structure 104 (e.g., having serpentine flexible elements). The annular support structure 104 is as generally described in FIGS. 11 and 12 except the flexible elements 114 have a serpentine shape. As depicted, the serpentine-shaped flexible elements 114 are part of a single structure 130 that extends circumferentially 68 360 degrees about the longitudinal axis 70. The single structure 130 includes multiple serpentine-shaped flexible elements 114. The structure 130 extends axially 64 from side 126 to side 128. As depicted, the inner ring 110, the outer ring 112, and the structure 130 are integrated together to form a single structure. As depicted in FIG. 14, 124 seal is disposed on side 128 of the annular support structure 104. In certain embodiments, the one or more seals 124 may be disposed on one or both sides 126, 128 of the annular support structure 104. The seals 124 are as described above in FIGS. 11 and 12.

Figure 15:
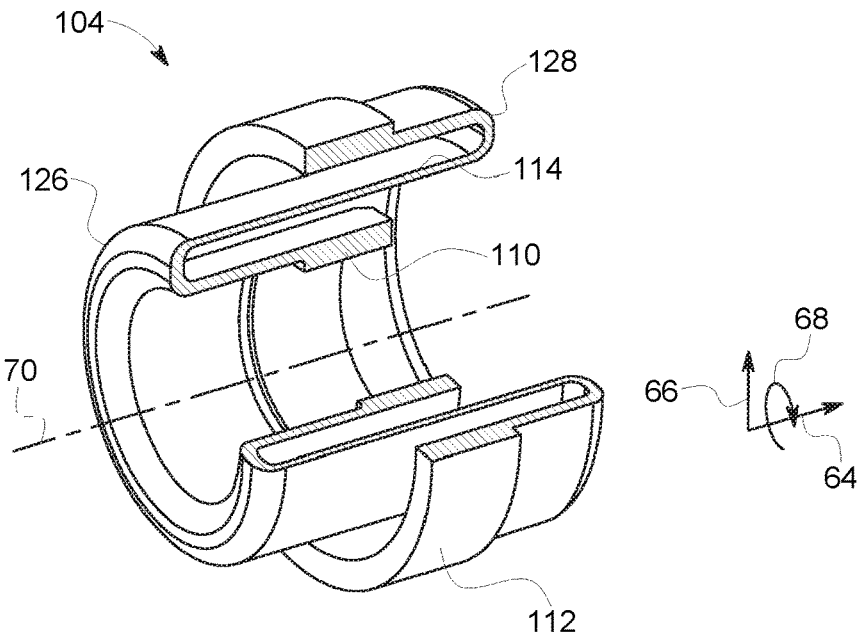
FIG. 15 is a partial perspective view of an embodiment of an annular support structure (e.g., having a single flexible element)
Figure 16:
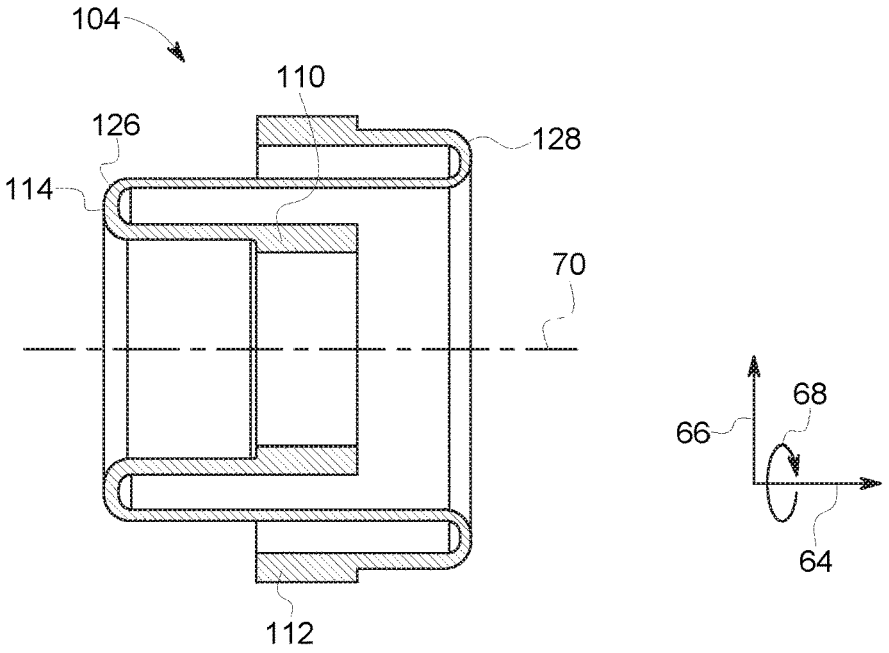
FIG. 16 is lateral cross-sectional view of the annular support structure of FIG. 15.
Figure 17:
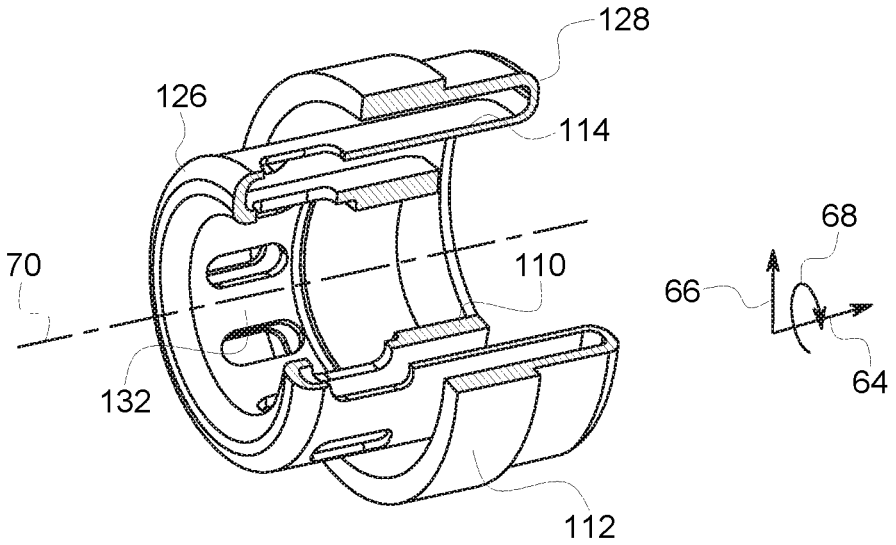
FIG. 17 is a partial perspective view of an embodiment of an annular support structure (e.g., having a single flexible element with ribs)
Figure 18:
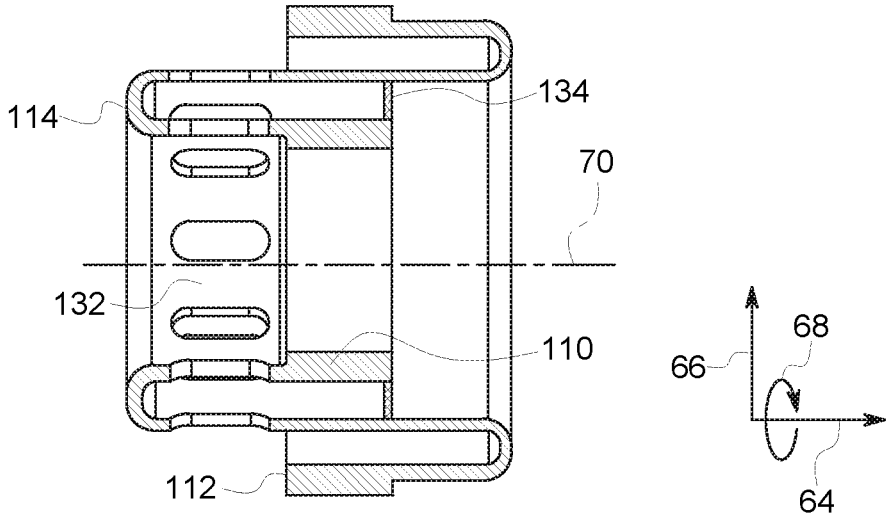
FIG. 18 is a lateral cross-sectional view of the annular support structure of FIG. 17.
Figure 19:
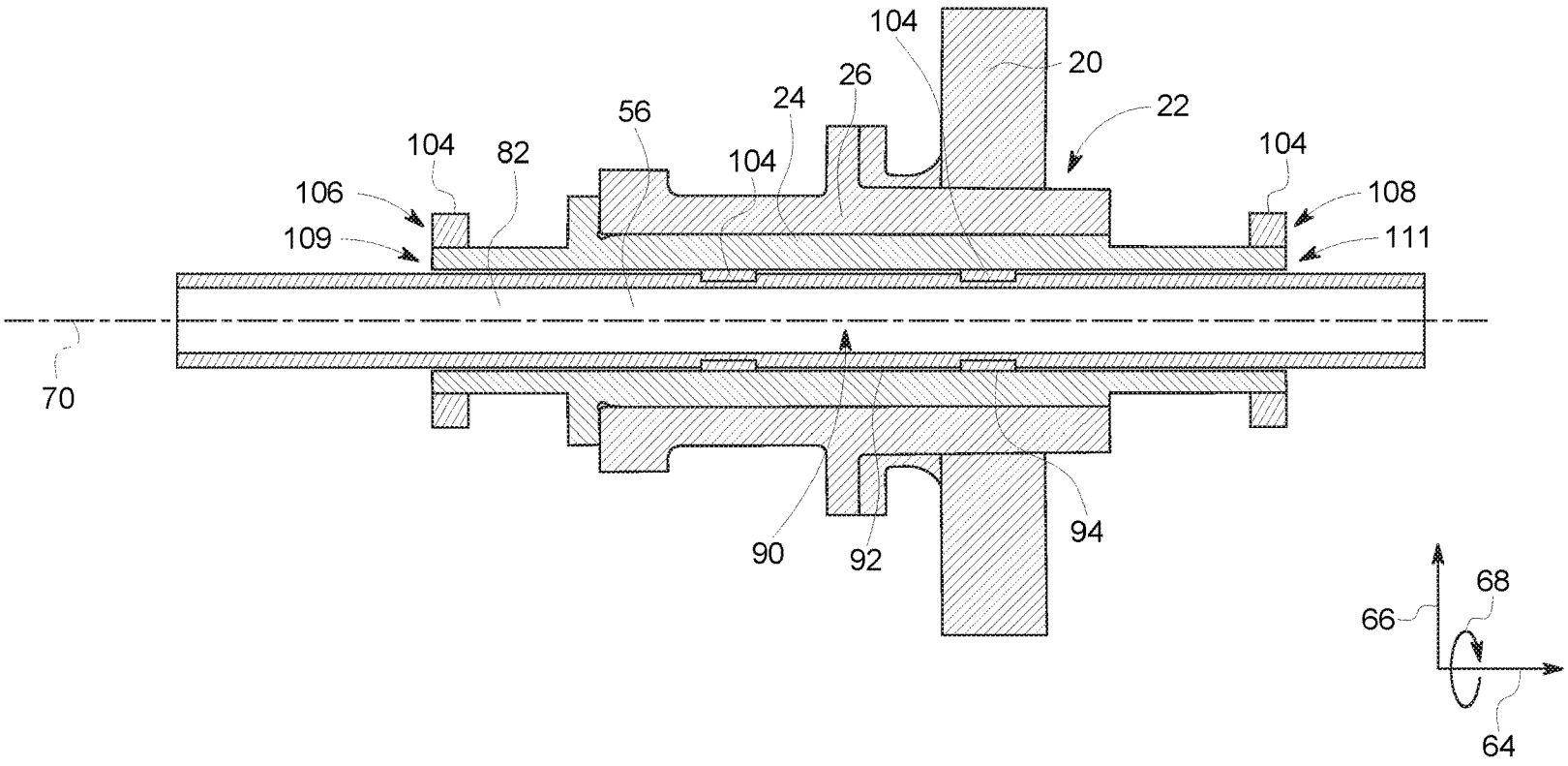
FIG. 19 is a diagrammatical illustration of embodiment of a bearing within an X-ray tube having support features (e.g., secondary having support structures disposed about it) in and on a shaft.

FIGS. 15 and 16 are, respectively, partial perspective and lateral cross-sectional views of an embodiment the annular support structure 104 (e.g., having a single flexible element). The annular support structure 104 is as generally described in FIGS. 11 and 12 except the annular support structure 104 includes a single flexible element 114. As depicted, the flexible element 114 is annularly shaped. The flexible element 114 extends in the axial direction 64 beyond the outer ring 112, while extending in the opposite axial direction 64 beyond the inner ring 110. As depicted, the inner ring 110, the outer ring 112, and the flexible element 114 are integrated together to form a single structure. In certain embodiments, as depicted in FIGS. 17 and 18, both the flexible element 114 and the inner ring 110 include ribs 132. In certain embodiments, only the flexible element or the inner ring 110 include the ribs 132. As depicted in FIG. 18, seal 134 (e.g., annular seal) is disposed between the flexible element 114 and the inner ring 110 to enable providing a sealing vacuum.

Technical effects of the disclosed embodiments include support features to minimize bending moment (and thus relative deflection relative to a bearing sleeve) along a surface of a shaft of a bearing (liquid metal bearing, ball bearing, journal bearing, spiral groove bearing, etc.). In certain embodiments, the support feature may include a recess (e.g., relief undercut) adjacent one end or both ends of the shaft. In other embodiments, the support feature may include a cavity formed within the shaft. In certain embodiments, the support feature may include a secondary shaft disposed within the shaft that extends along a longitudinal a length of the stationary member. The secondary shaft may include one or more protrusions that radially extend from the shaft and contact an inner surface of the shaft at optimal locations reducing relative deflection. In certain embodiments, one or more annular support structures may be disposed about the secondary shaft to enable control of rotor dynamics of the bearing. The disclosed embodiments may minimize deflection of the shaft relative to the bearing sleeve (i.e., relative deflection) by minimizing bending moments along a surface of the shaft. This may result in minimizing or eliminating rubbing between the shaft and the bearing sleeve. In addition, the maximum usable eccentricity and the load carrying capability of the shaft may be increased.

This written description uses examples to disclose the subject matter, including the best mode, and also to enable any person skilled in the art to practice the subject matter, including making and using any devices or systems and performing any incorporated methods. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A bearing for an X-ray tube, comprising:

a stationary member;

a rotary member configured to rotate with respect to the stationary member during operation of the X-ray tube;

a support feature configured to minimize bending moment along a surface of the stationary member to reduce deflection of the stationary member relative to the rotary member due to radial loads during operation of the X-ray tube, wherein the support feature comprises a shaft disposed within the stationary member along a longitudinal length of the stationary member, and wherein the shaft is configured to absorb relative deflection due to the radial loads; and at least one annular support structure disposed about the shaft between the shaft and the stationary member, wherein the annular support structure is configured to control rotor dynamics of the bearing.

2. The bearing of claim 1, wherein the support feature comprises a first recess formed within a first end of the stationary member, and the first recess extends in both a circumferential direction and an axial direction relative to a longitudinal axis of the stationary member.

3. The bearing of claim 2, wherein the support feature comprises a second recess formed within a second end of the stationary member, and the second recess extends in both the circumferential direction and the axial direction relative to the longitudinal axis of the stationary member.

4. The bearing of claim 1, wherein the support feature comprises at least one cavity disposed within stationary member, and the at least one cavity extends in both a circumferential direction and an axial direction relative to a longitudinal axis of the stationary member.

5. The bearing of claim 1, wherein the shaft comprises one or more protrusions that extend from an outer surface of the shaft in both a circumferential direction and a radial direction relative to a longitudinal axis of the stationary member, wherein the one or more protrusions contact an inner surface of the stationary member and radially support the stationary member at locations to minimize bending moments.

6. The bearing of claim 5, wherein the one or more protrusions are configured to generate an inverse deflection under small radial loads to optimize bearing deflection under higher radial load.

7. The bearing of claim 1, wherein the shaft comprises a single piece or two pieces.

8. The bearing of claim 1, wherein the at least one annular structure comprises an outer ring, an inner ring, and at least one flexible element radially disposed between the outer ring and the inner ring.

9. The bearing of claim 8, wherein the at least one annular structure comprises a protrusion that radially extends from the inner ring towards the outer ring, wherein the protrusion is configured to limit radial movement of the inner ring relative to the outer ring.

10. The bearing of claim 1, wherein the at least one annular structure comprises at least one seal disposed on a side of the at least one annular structure.

11. A bearing for an X-ray tube, comprising:

a stationary member;

a rotary member configured to rotate with respect to the stationary member during operation of the X-ray tube;

a shaft disposed within the stationary member along a longitudinal length of the stationary member, wherein the shaft is configured to minimize bending moment along a surface of the stationary member to reduce deflection of the stationary member relative to the rotary member due to radial loads during operation of the X-ray tube; and at least one annular support structure disposed about the shaft between the shaft and the stationary member, wherein the annular support structure is configured to control rotor dynamics of the bearing.

12. The bearing of claim 11, wherein the shaft is configured to absorb relative deflection due to the radial loads.

13. The bearing of claim 11, wherein the shaft comprises one or more protrusions that extend from an outer surface of the shaft in both a circumferential direction and a radial direction relative to a longitudinal axis of the stationary member, wherein the one or more protrusions contact an inner surface of the stationary member and radially support the stationary member at locations to minimize bending moments.

14. A bearing for an X-ray tube, comprising:

a stationary member;

a rotary member configured to rotate with respect to the stationary member during operation of an X-ray tube; and a shaft disposed within the stationary member along a longitudinal length of the stationary member, wherein the shaft is configured to minimize bending moment along a surface of the stationary member to reduce deflection of the stationary member relative to the rotary member due to radial loads during operation of an X-ray tube;

wherein the shaft comprises one or more protrusions that extend from an outer surface of the shaft in both a circumferential direction and a radial direction relative to a longitudinal axis of the stationary member, wherein the one or more protrusions contact an inner surface of the stationary member and radially support the stationary member at locations to minimize bending moments.

* * * * *